US006482316B1

(12) United States Patent
Bal

(10) Patent No.: US 6,482,316 B1
(45) Date of Patent: Nov. 19, 2002

(54) ADSORPTION PROCESS FOR PRODUCING ULTRA LOW HYDROCARBON STREAMS

(75) Inventor: Kaul Krishan Bal, Randolph, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/522,878

(22) Filed: Mar. 10, 2000

Related U.S. Application Data

(60) Provisional application No. 60/138,687, filed on Jun. 11, 1999.

(51) Int. Cl.[7] ..... C10G 25/00; C10G 25/12

(52) U.S. Cl. ..... 208/299; 208/305; 208/302; 208/307; 208/208 R; 208/248; 208/297; 208/250; 585/820; 585/826

(58) Field of Search ..... 208/299, 305, 208/302, 307, 208 R, 248, 297, 250; 585/820, 826

(56) References Cited

U.S. PATENT DOCUMENTS

| | | | | | |
|---|---|---|---|---|---|
| 3,182,014 | A | * | 5/1965 | Seelig et al. | 208/245 |
| 3,450,629 | A | * | 6/1969 | Sudduth et al. | 208/305 |
| 3,725,299 | A | * | 4/1973 | Turnock et al. | 252/411 S |
| 3,922,217 | A | * | 11/1975 | Cohen et al. | 208/299 |
| 4,225,319 | A | * | 9/1980 | Thomas | 208/17 |
| 4,234,314 | A | | 11/1980 | Jones et al. | 23/230 |
| 4,430,205 | A | | 2/1984 | Felsky | 208/246 |
| 4,831,206 | A | | 5/1989 | Zarchy | 585/737 |
| 4,831,207 | A | | 5/1989 | O'Keefe et al. | 585/737 |
| 4,831,208 | A | | 5/1989 | Zarchy | 585/737 |
| 4,835,338 | A | * | 5/1989 | Liu | 585/823 |
| 4,952,746 | A | | 8/1990 | Johnson et al. | 585/802 |
| 5,082,987 | A | | 1/1992 | Olbrich et al. | 585/737 |
| 5,109,139 | A | * | 4/1992 | Dickenson et al. | 585/821 |
| 5,164,076 | A | | 11/1992 | Zarchy et al. | 208/245 |
| 5,171,923 | A | * | 12/1992 | Dickenson et al. | 585/821 |
| 5,212,128 | A | | 5/1993 | Schorfheide et al. | 502/31 |
| 5,220,099 | A | * | 6/1993 | Schreiner et al. | 585/820 |
| 5,264,187 | A | | 11/1993 | Olbrich et al. | 422/190 |
| 5,271,835 | A | * | 12/1993 | Gorawara et al. | 208/228 |
| 5,306,681 | A | | 4/1994 | Schorfheide et al. | 502/22 |

(List continued on next page.)

FOREIGN PATENT DOCUMENTS

| | | | |
|---|---|---|---|
| EP | 0284228 A1 | 9/1988 | C10G/25/12 |
| FR | 1017576 | 12/1952 | |
| GB | 707606 | 4/1954 | |

*Primary Examiner*—Nadine Preisch
(74) *Attorney, Agent, or Firm*—Estelle C. Bakun; Linda M. Scuorzo; Gerald J. Hughes

(57) ABSTRACT

The instant invention is directed to a method for reducing the amount of sulfur in hydrocarbon streams comprising the steps of:

(a) contacting a hydrocarbon stream comprising hydrocarbons and sulfur compounds with an adsorbent selective for adsorption of said sulfur compounds, under adsorption conditions capable of retaining said sulfur compounds on said adsorbent and obtaining an adsorption effluent comprising a desulfurized hydrocarbon stream, (b) collecting said desulfurized hydrocarbon stream, (c) desorbing said sulfur compounds from said adsorbent by passing a desorbent through said adsorbent under desorption conditions to obtain a desorption effluent comprising sulfur compounds and said desorbent, (d) treating said desorption effluent to remove said sulfur compounds from said desorption effluent and collecting a desulfurized desorbent effluent comprising desorbent.

9 Claims, 1 Drawing Sheet

U.S. PATENT DOCUMENTS 5,454,933 A 10/1995 Savage et al. ..... 208/212
5,730,860 A * 3/1998 Irvine ..... 208/213
5,750,820 A * 5/1998 Wei ..... 585/826
5,792,897 A 8/1998 Rosser, Jr. et al. ..... 585/738
5,807,475 A 9/1998 Kulprathipanja et al. ... 208/208
5,843,300 A 12/1998 Zinnen et al. ..... 208/250
5,849,981 A 12/1998 Kulprathipanja ..... 585/828
5,912,395 A * 6/1999 Noe ..... 585/820
5,935,422 A * 8/1999 Zinnen ..... 208/310 Z
6,126,814 A * 10/2000 Lapinski et al. ..... 208/217

* cited by examiner

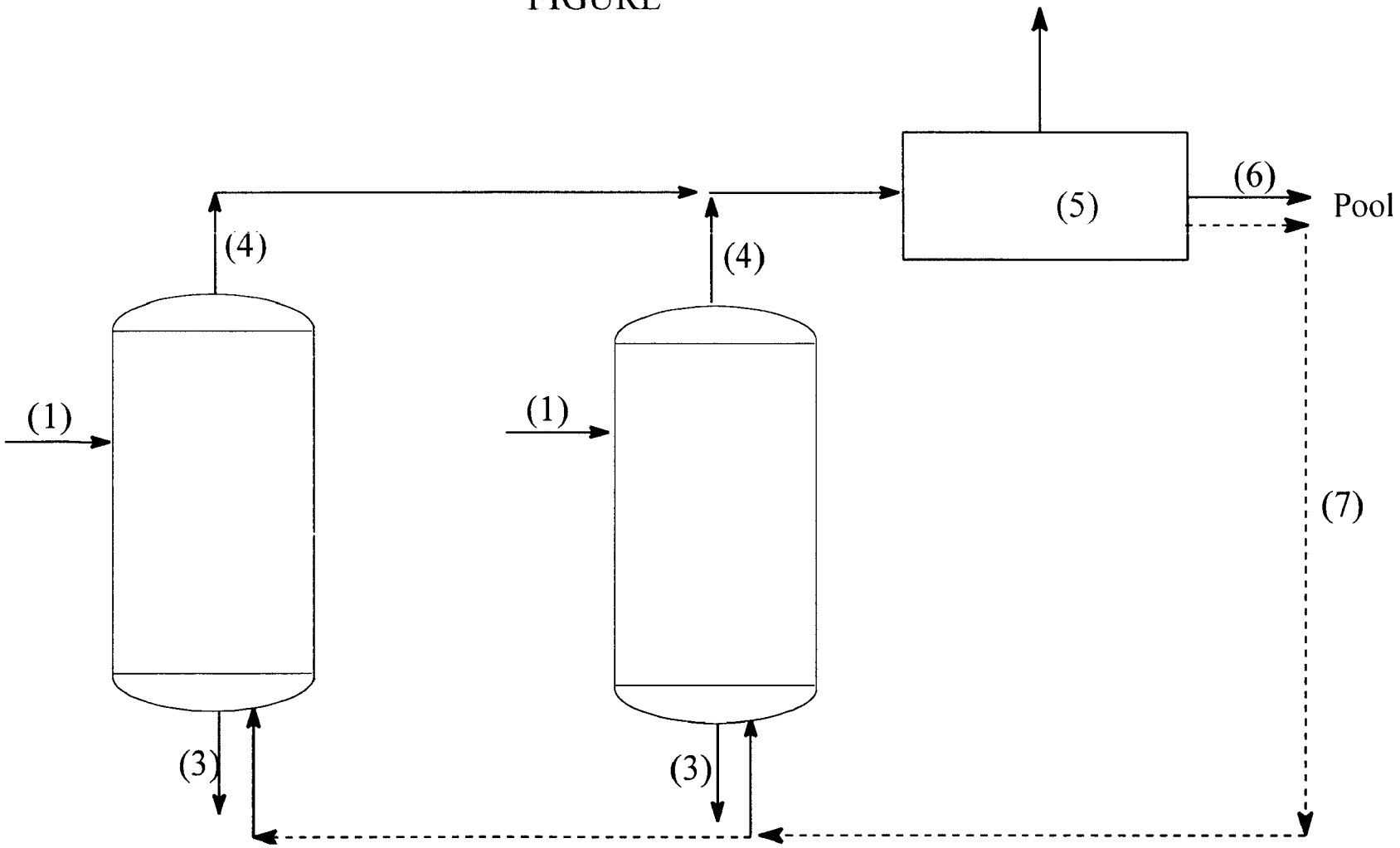
FIGURE

ADSORPTION PROCESS FOR PRODUCING ULTRA LOW HYDROCARBON STREAMS

This application claims benefit of provisional application No. 60/138,687, filed Jun. 11, 1999.

FIELD OF THE INVENTION

The instant process is directed to an adsorption method for producing ultra low sulfur hydrocarbon streams, specifically naphthas while preserving octane.

BACKGROUND OF THE INVENTION

Due to environmental regulations the amount of sulfur present in naphtha streams must be closely controlled. The regulations will require the amount of sulfur in gasolines to be reduced to about 150 ppm by the year 2000, with further reduction to about 30 ppm by the year 2004. Thus, there is a critical need for technologies that are capable of lowering the amount of sulfur present in naphtha streams.

Present technology for lowering the amount of sulfur in naphtha streams is accompanied by an octane loss since the technology saturates the olefins present in the streams. Thus, following the sulfur removal, the streams must be isomerized to regain octane. Such processes include the Mobil-Oct Gain and UOP/Intevap ISAL processes. However, these processes have substantial yield losses and are prohibitively expensive.

SUMMARY OF THE INVENTION

The instant invention is directed to a method for reducing the amount of sulfur in hydrocarbon streams comprising the steps of:

(a) contacting a hydrocarbon stream comprising hydrocarbons and sulfur compounds with an adsorbent selective for adsorption of said sulfur compounds, under adsorption conditions capable of retaining said sulfur compounds on said adsorbent and obtaining an adsorption effluent comprising a desulfurized hydrocarbon stream, (b) collecting said desulfurized hydrocarbon stream, (c) desorbing said sulfur compounds from said adsorbent by passing a desorbent through said adsorbent under desorption conditions to obtain a desorption effluent comprising sulfur compounds and said desorbent, (d) treating said desorption effluent to remove said sulfur compounds from said desorption effluent and collecting a desulfurized desorbent effluent comprising desorbent.

The process may likewise comprises step (e) recycling said desulfurized desorbent effluent of said step (d) to said step (c).

The process may alternatively comprise combining said desulfurized desorbent effluent of said step (d) with said desulfurized hydrocarbon stream of said step (b) in a mogas pool.

BRIEF DESCRIPTION OF THE FIGURE

The FIGURE depicts one possible configuration for operating an embodiment of the invention using as the desorbent. The FIGURE shows two adsorption zones. In such a case, one adsorbent can be in use while the other is being regenerated with desorbent to remove adsorbed sulfur compounds therefrom. The hydrocarbon stream to be desulfurized (1) is passed through an adsorbent (2), the hydrocarbon stream having sulfur removed therefrom (product) is then collected (3), the desorbent (8) is then passed through the adsorbent and desorbs the adsorbed sulfur. The desorbent and sulfur (4) are then passed to a reaction process (5) here a hydrofiner, where sulfur is removed as $H_2S$ (9) leaving a stream comprising desulfurized desorbent. The desulfurized desorbent (6) may then be recycled back (7) to the adsorbent for further use in desorbing sulfur or can alternatively be added, for example to the mogas pool.

DETAILED DESCRIPTION OF THE INVENTION

The instant invention describes a method for removing substantially all of the sulfur compounds from hydrocarbon streams. Preferably, the hydrocarbon streams will be hydrocarbon streams containing olefins. Typically, the sulfur compounds will be removed to levels of less than about 60 wppm, more typically, less than about 50 wppm, even more typically less than about 20 wppm, preferably less than 10 wppm. Conventional treatment to remove sulfurs, which involves conversion of the sulfur compounds to hydrogen sulfide, in a hydrotreating process is detrimental for such streams since the olefins are saturated thereby causing an octane loss. The streams must then be isomerized to replenish the octane. An embodiment of the invention allows the sulfurs to be removed without hydrotreating the sulfur containing hydrocarbon stream and thereby preserves the octane of the treated hydrocarbon streams. Thus, the invention is particularly beneficial for hydrocarbon streams containing olefins where conventional sulfur removal is accompanied by octane loss. More specifically, the invention is particularly suited for removal of sulfur compounds from streams such as light (LCN) and intermediate cat naphthas (ICN). Heavy cat naphtha (HCN) may also be treated as described herein to remove sulfur compounds if desired. However, it is recognized that the octane loss associated with hydrotreating LCN and ICN is less significant in hydrotreating HCN.

The instant invention affords several benefits. Existing refinery streams can be utilized as desorbent. Typically refinery streams containing less than about 70, preferably less than about 30, and most preferably less than about 10 ppm sulfur will be utilized. If refinery streams such as reformate are utilized as desorbent, once the desorbed sulfur compounds are separated therefrom, the desulfurized reformate stream can be combined with the desulfurized hydrocarbon stream to form, for example part of the mogas pool, in the case where naphthas are being desulfurized. Typically, such pools will contain about 30 ppm sulfur or less. Furthermore, since the stream to be treated in accordance with the instant invention needn't be hydrotreated prior to entering the adsorber, no octane loss occurs.

Preferably, the desorbents will boil in the range of the hydrocarbon stream being desulfurized so as to eliminate the need to remove any minor levels of the desorbent that wind up in the desulfurized hydrocarbon product as a result of minor amounts of desorbent remaining in the adsorbent. Thus, in the case of naphthas being treated in accordance with the instant invention, refinery streams such as those boiling in about 50 to about 300° F. will be utilized. Other refinery streams could also be utilized and could be separated from the desulfurized hydrocarbon product, if desired, by means known to the skilled artisan. For example, by distillation.

One of the advantages of the process described herein is that yield losses of the hydrocarbon streams containing sulfur can be avoided. Upon desorbing the sulfur compounds, a volume of desorption effluent equivalent to at least 80% and preferably at least about 100% of the adsorbent bed is recycled to be combined with the stream comprising hydrocarbon and sulfur compounds for processing in the adsorption step. Alternatively, the recycled desorption effluent can be added directly back to the adsorption step without first being combined with the stream to be desulfurized. This allows for any hydrocarbon feedstock entrained in the adsorption bed to be recovered preventing any yield losses.

Preferably, in the case of desulfurization of naphtha streams a reformate will be utilized as the desorbent. Recycling of at least 80% of the adsorbent bed volume as described above, of the reformate desorption effluent eliminates yield losses. Since the reformate is typically combined with the mogas pool, and any small amounts of naphtha trapped by the adsorbent will be desorbed by the reformate, the entrained naphtha will either be recycled as described above, or be combined with the mogas pool once the desorption effluent is treated for sulfur removal.

The adsorption step can be conducted at any suitable conditions. Typically, the adsorption step will be performed at temperatures of about room temperature to about 300° F. The desorption will be conducted at temperatures from about room temperature up to about 400° C.

For the instant, it is preferable to utilize a desorbent that can be desulfurized without the use of expensive processes such as distillation. For example, when desulfurizing a naphtha stream it is preferable to use a reformate as desorbent. The sulfur desorbed can then be removed from the reformate by a typical hydrofining process and the reformate then reused as desorbent or combined in a mogas pool if desired. In such a scheme, no distillation column would be necessary. The reformate could simply be treated in a hydrotreating unit existing in the refinery such as a diesel hydrofining unit to remove the desorbed sulfur species. Other desorbents can likewise be utilized, but may require a distillation step to separate out the desorbed sulfur compounds from the desorbent. Likewise, if entrained desulfurized hydrocarbon is removed with the desorbent, and the desorbent is not added to the same pool as the desulfurized hydrocarbon stream, it may be desirable to separate the entrained desulfurized hydrocarbon from the desorbent as well.

Typical desorbents that can be used in the instant process include, but are not limited to organic solvents, both aromatic and non-aromatic, which can be easily separated from the sulfur compounds by conventional techniques such as hydrodesulfurization or distillation such as reformate, toluene and mixtures thereof. If the selected separation technique is distillation, the boiling point of the desorbent should differ from the sulfur compounds by at least about 5° C., preferably, at least about 10° C. The skilled artisan can readily select suitable desorbents. Preferably, reformate will be used. Preferably, if one desires to preserve octane, the desorbent selected will contain less than about 1 percent olefins. In such a case, very little octane in the desorbent will be lost when the desorbent is treated to remove sulfur compounds therefrom.

The processes used to separate the desorbent from the sulfur compounds desorbed are run under conditions well known in the art. For example, if hydrotreating is selected, typical conditions include temperatures from about 200 to about 425, preferably from about 300 to about 425° C. Pressures range from about 100 to about 1500, preferably about 250 to about 1200 psig. Liquid space velocities range from about 0.05 to about 6 V/Hr/V, and a hydrogen gas rate of about 500 to about 6000 SCF/B, where SCF/B means standard cubic feet per barrel, and V/Hr/V means volume of fuel per hour per volume of the reactor. Any hydrodesulfurization catalyst may be used. For example a Group VI metal with one or more Group VIII metals as promoters on a refractory support. Such catalysts are well known in the art.

Typical adsorbents include porous inert materials capable of removing substantially all of the sulfur compounds from the stream being treated. For example, activated carbon, zeolites, silica gels, alumina, CoMo sorbents, activated coke, adsorbents impregnated with metals and mixtures thereof.

The instant process can be made continuous by utilizing two or more adsorption zones. When at least two adsorbers, or zones are utilized, one can be regenerated by passing desorbent therethrough, while the other is in the adsorption mode thus allowing the process to be continuous. This alleviates the need to stop the adsorption to regenerate (desorb sulfur compounds) from the adsorbent. When more than one adsorption zone is present, the zones are cycled or switched in service at intervals that will preclude breakthrough of the adsorbed sulfur compounds. In this manner, a continuous flow of the hydrocarbon stream to be desulfurized can be passed to an adsorber and the effluent collected.

In the instant invention, when naphtha streams are being treated, the desulfurized adsorption effluent is collected. No further processing is required. The adsorption produces an ultra low sulfur cat naphtha which can be utilized and combined with the mogas pool.

The process can be run such that the adsorption bed or zone is a fixed, moving, simulated moving, or magnetically stabilized bed. Additionally, If a plurality of adsorbers are utilized, each could contain a different type of bed, making a combination of the above types of beds possible.

The following examples are illustrative and are not meant to be limiting in any way.

Example 1

Table 1 shows decrease in sulfur for a cat naphtha feed processed in accordance with the instant invention.

TABLE 1

| | Flow | | Sulfur |
|---|---|---|---|
| Stream | KB/SD | kilo Lbs/hour | Concentration |
| Cat Naphtha Adsorber feed | 20.00 | 236.484 | 300 wppm |
| Reformate Desorbent | 5.06 | 59.56 | <1 wppm |
| Desulfurized Adsorber effluent (Low Sulfur Cat Naphtha) | 20.01 | 236.963 | <10 wppm |
| Mogas pool Desorbent + Sulfur compounds | 5.10 | 60.09 | 1150 wppm |

What is claimed is:

1. A method for reducing the amount of sulfur in refinery streams containing greater than 30 ppm sulfur, comprising the steps of:

(a) contacting said refinery stream boiling in the range of about 50 to 300° F. comprising hydrocarbons and sulfur compounds with an adsorbent in an adsorbent bed selective for adsorption of said sulfur compounds, under adsorption conditions capable of retaining said sulfur compounds on said adsorbent and obtaining an adsorption effluent comprising a desulfurized refinery stream, (b) collecting said desulfurized refinery stream, (c) desorbing said sulfur compounds from said adsorbent by passing a desorbent through said adsorbent under desorption conditions to obtain a desorption effluent comprising sulfur compounds and said desorbent, wherein said desorbent is a refinery stream boiling in the range of about 50 to 300° F. and containing less than about 30 ppm sulfur;

(d) treating said desorption effluent to remove said sulfur compounds from said desorption effluent and collecting a desulfurized desorbent effluent comprising desorbent, and (e) combining said desulfurized refinery stream of said step (a) and said desulfurized desorbent effluent of said step (d) to form a desulfurized refinery stream pool.

2. The process of claim 1 wherein said desorbent is reformate and said step (d) is a hydrofining step conducted under hydrofining conditions.

3. The process of claim 1 wherein said adsorbent is selected from the group consisting of activated carbon, zeolites, silica gels, alumina, CoMo sorbents, activated coke, and mixtures thereof.

4. The process of claim 3 wherein said adsorbents are metal impregnated adsorbents.

5. The process of claim 1 wherein said desorbent is a reformate stream.

6. The process of claim 1 wherein said desorbent contains less than 1% olefins.

7. The process of claim 1 wherein an amount of desorbent effluent equivalent to at least about 80 volume % of the adsorbent bed is recycled back to said step (c).

8. The process of claim 1 wherein said refinery stream pool is a mogas pool and contains about 30 ppm sulfur or less.

9. The process of claim 1 wherein said adsorbent bed is a bed selected from the group consisting of moving beds, simulated moving beds and magnetically stabilized beds.

* * * * *

UNITED STATES PATENT AND TRADEMARK OFFICE

CERTIFICATE OF CORRECTION

PATENT NO. : 6,482,316 B1
DATED : November 19, 2002
INVENTOR(S) : Kaul Krishnan Bal It is certified that error appears in the above-identified patent and that said Letters Patent is hereby corrected as shown below:

Title page,
Item [75], "Inventor: Kaul Krishnan Bal" should read -- Inventor: Bal Krishnan Kaul --.

Signed and Sealed this

Twenty-ninth Day of April, 2003

JAMES E. ROGAN
*Director of the United States Patent and Trademark Office*